United States Patent [19]

Artzberger

[11] Patent Number: 4,758,114

[45] Date of Patent: Jul. 19, 1988

[54] VIBRATORY CONCRETE SCREED

[75] Inventor: Thomas G. Artzberger, Menomonee Falls, Wis.

[73] Assignee: M-B-W Inc., Slinger, Wis.

[21] Appl. No.: 15,734

[22] Filed: Feb. 17, 1987

[51] Int. Cl.[4] ..... E01C 19/22

[52] U.S. Cl. ..... 404/119; 404/114

[58] Field of Search ..... 404/96, 114, 118, 119, 404/120; 425/456

[56] References Cited

U.S. PATENT DOCUMENTS

| | | | |
|---|---|---|---|
| 1,181,013 | 4/1916 | Inglis | 14/4 |
| 2,219,247 | 10/1940 | Jackson | 404/114 |
| 2,255,343 | 9/1941 | Baily | 404/114 |
| 2,306,126 | 12/1942 | Jackson | 404/114 |
| 2,314,985 | 3/1943 | Jackson | 404/114 |
| 2,542,979 | 2/1951 | Barnes | 404/114 |
| 3,008,388 | 11/1961 | Nave | 404/114 |
| 3,883,259 | 5/1975 | Berg | 404/120 |
| 4,030,873 | 6/1977 | Morrison | 425/456 |
| 4,073,593 | 2/1978 | Storm | 404/114 |
| 4,105,355 | 8/1978 | King et al. | 404/114 |
| 4,213,749 | 7/1980 | Morrison | 425/456 |
| 4,253,778 | 3/1981 | Morrison | 404/114 |
| 4,261,694 | 4/1981 | Morrison | 425/456 |
| 4,340,351 | 7/1982 | Owens | 404/118 |
| 4,375,351 | 3/1983 | Allen | 404/119 X |
| 4,427,358 | 1/1984 | Stilwell | 404/119 X |
| 4,466,757 | 8/1984 | Allen | 404/119 X |
| 4,577,994 | 3/1986 | Miller | 404/114 |

OTHER PUBLICATIONS

"Screedmaster", Aws Manufacturing Inc., Dayton, OH.

"The Keg Screed", Keg Manufacturing Company, La Habra, CA.

"The Morrison Lightweight Aluminum Screed", Morrison Concrete & Equipment Inc., Charlotte, NC.

"Morrison's Vibrating Screeds", Morrison's Concrete & Equipment, Inc., Charlotte, NC.

*Primary Examiner*—Jerome Massie

*Assistant Examiner*—Matthew Smith

*Attorney, Agent, or Firm*—Andurs, Sceales, Starke & Sawall

[57] ABSTRACT

A vibratory concrete screed composed of a plurality of interconnected sections. Each section includes a series of frame members which are located at an acute angle with respect to the longitudinal axis of the section. Each frame member is generally triangular in configuration and is composed of a base and a pair of sides which are connected together at an apex. The ends of the bases of the frame members are connected to a pair of parallel screed plates, while a ridge tube is connected to the apices of the frame members. The ridge tubes of adjacent sections are connected together by an adjustable connecting mechanism, and axial adjustment of the ridge tubes will tend to tilt the screed plates of one section relative to the adjacent section to provide the desired crown for the screed. The central portion of the base of each frame member is provided with a tubular hub and in one embodiment, the aligned hubs receive an eccentric shaft that is operably connected to an engine to provide vibratory motion for the screed. In another form of the invention, an air supply tube is mounted within the aligned hubs, and conduits serve to supply air under pressure from the supply tube to individual pneumatic vibrators mounted along the length of the screed.

10 Claims, 3 Drawing Sheets

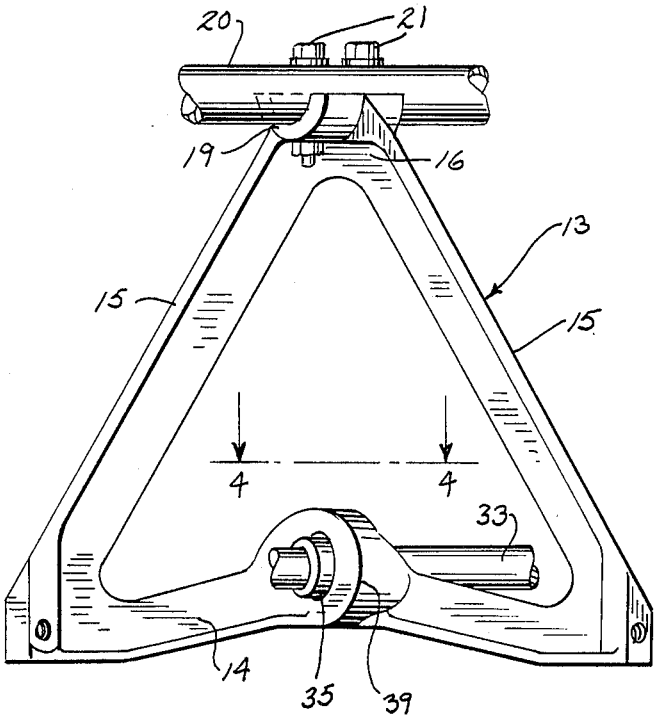
FIG. 3
FIG. 4
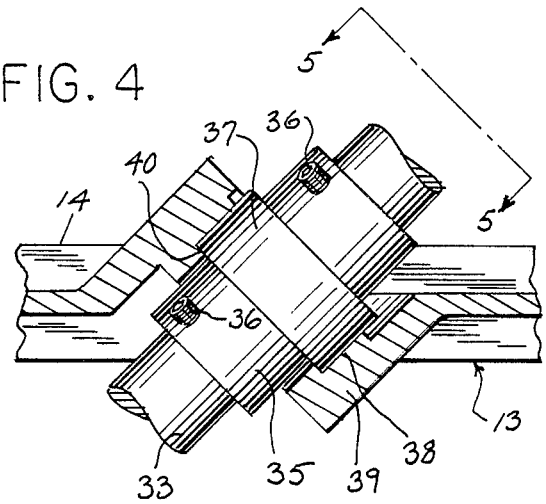
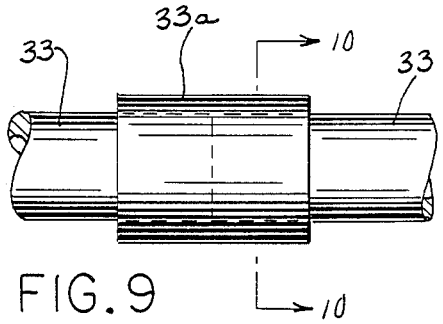
FIG. 9
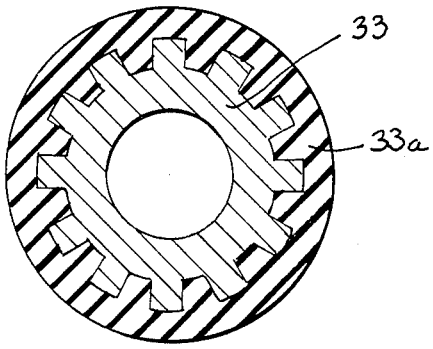
FIG. 10
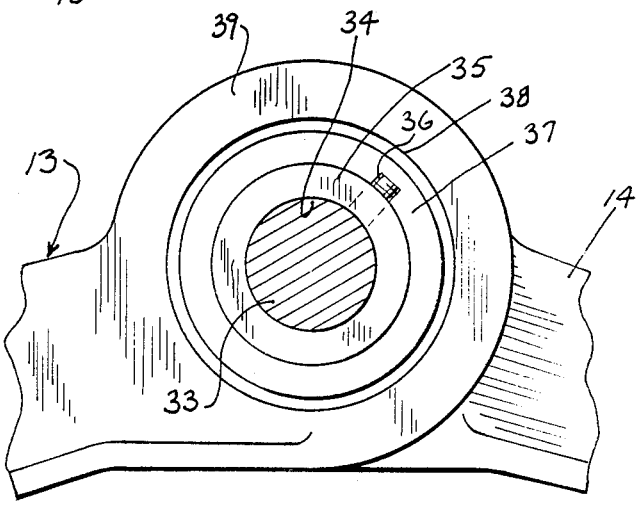
FIG. 5

FIG. 6
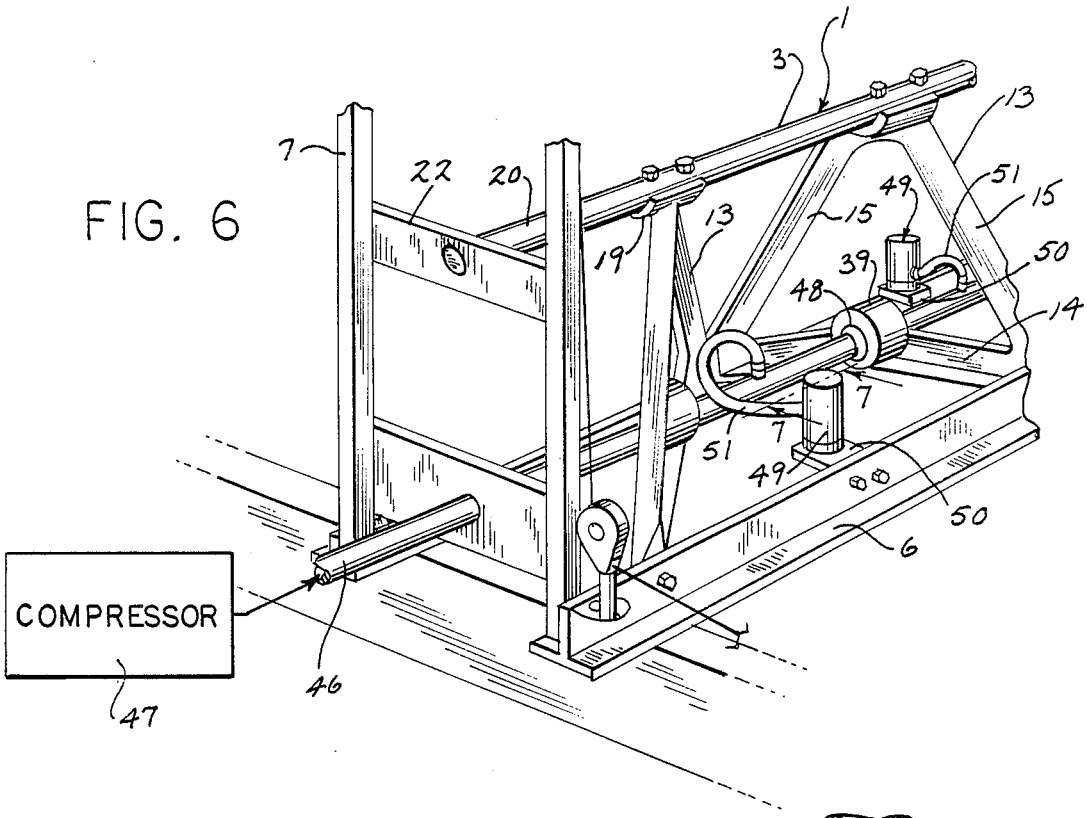
FIG. 7
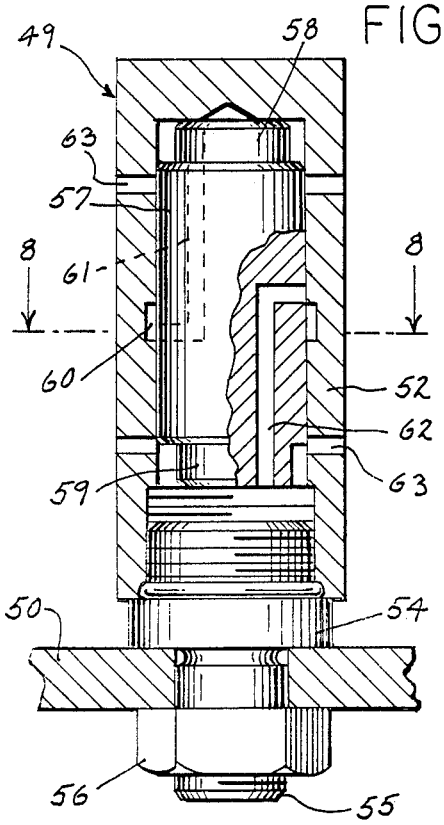
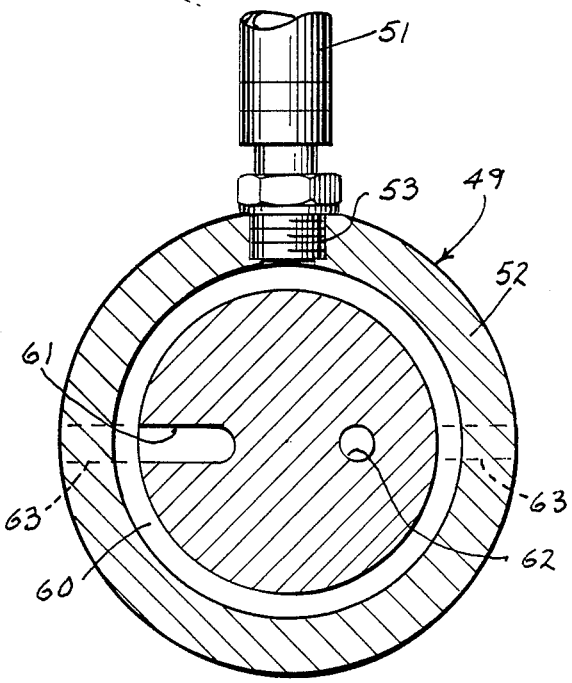
FIG. 8

VIBRATORY CONCRETE SCREED

BACKGROUND OF THE INVENTION

Vibratory screeds are frequently employed to impart vibrations to poured concrete for tamping and leveling of the concrete as it is finished. The screed eliminates the tedious manual labor involved in finishing the concrete and therby increases productivity in laying of the concrete as well as improving the quality of the finished concrete slab by providing more accurately controlled slab surfaces as well as controlling the crown.

In addition, the uniform vibratory action that is achieved by a screed will increase the concrete density and load bearing capacity of the finished slab.

It is desirable that a screed be light in weight and formed in sections so that the length of the screed can be readily changed to meet the dimensions of the slab. In the past, the screeds have generally been formed with a truss like construction in which light weight metal braces are arranged in a truss-like pattern to support the screed plates.

U.S. Pat. No. 4,340,351 discloses a vibratory concrete screed composed of a series of parallel, generally triangular, frame members. The corners of the triangular frame members are connected to the screed plates and a ridge tube is connected across the upper ends of the frame members. In the aforementioned patent, diagonal braces are connected between adjacent parallel frame members.

SUMMARY OF THE INVENTION

The invention is directed to an improved light weight vibratory concrete screed. The screed of the invention is composed of one or more sections located in end-to-end relation and each section includes a plurality of generally triangular frame members, preferably cast of a light weight material such as aluminum. The triangular frame members are disposed at an acute angle preferably about 45°, to the longitudinal axis of the screed section with each frame member being located at an angle, preferably 90°, to adjacent frame members.

The ends of the base of each triangular frame member are connected to the corresponding ends of adjacent frame members as well as to parallel screed plates, while the upper apex of each frame member is provided with a cradle that receives a ridge tube.

The ridge tubes of adjacent screed sections are attached together by an adjustable connection, and by axial adjustment of the ridge tubes the crown of the screed can be correspondingly varied. The adjustment for the ridge tube includes a pivoted connected so that the ridge tubes of adjacent sections can move relative to each other in a vertical plane to thereby eliminate undue stress on the adjusting mechanism.

In one form of the invention, vibration is imparted to the screed through mechanical means, such as a gasoline engine. In this form of the invention, the base of each triangular frame member is provided with a hub that defines an opening, and an eccentric shaft extends through the aligned openings in the hubs. The engine is operably connected to the shaft so that rotation of the eccentric drive shaft will impart vibration to the screed.

In a second form of the invention, an air supply tube is mounted within the aligned openings in the hubs of the frame members and the air supply tube communicates with a source of air or other gas under pressure. A series of conduits connect the air supply tube with individual pneumatic vibrators mounted along the length of the screed to thereby impart vibratory motion to the screed.

The eccentric drive mechanism provides substantially uniform vibration along the entire length of the screed to reduce the possibility of bearing failure.

With the eccentric drive mechanism of the invention, both the centrifugal force and the amplitude, which is the measure of vertical movement of the screed during vibration, can be readily adjusted to match the harshness and slump of the concrete.

As the triangular frame members are connected directly together through the screed plates or rails, the construction of the invention eliminates the need for auxiliary braces, thereby simplifying the construction and reducing the overall weight of the screed.

The design of the screed using the triangular, angularly set frame members provides high strength with minimum weight and minimizes angled or rounded corners to prevent the build-up of concrete on the screed, thereby enabling the screed to be more easily cleaned after the finishing operation.

Other objects and advantages will appear in the course of the following description.

DESCRIPTION OF THE DRAWINGS

The drawings illustrate the best mode presently contemplated of carrying out the invention.

In the drawings:

FIG. 3 is a view taken along line 3—3 of FIG. 2 and showing one of the triangular frame members;

FIG. 4 is a section taken along line 4—4 of FIG. 3;

FIG. 5 is a view taken along line 5—5 of FIG. 4;

FIG. 6 is a perspective view of a modified form of the invention using pneumatic vibrators;

FIG. 7 is a longitudinal section of a pneumatic vibrator;

FIG. 8 is a section taken along line 8—8 of FIG. 7;

FIG. 9 is a side elevation of the shaft coupling construction; and

FIG. 10 is a section taken along line 10—10 of FIG. 9.

DESCRIPTION OF THE ILLUSTRATED EMBODIMENT

Figure 1:
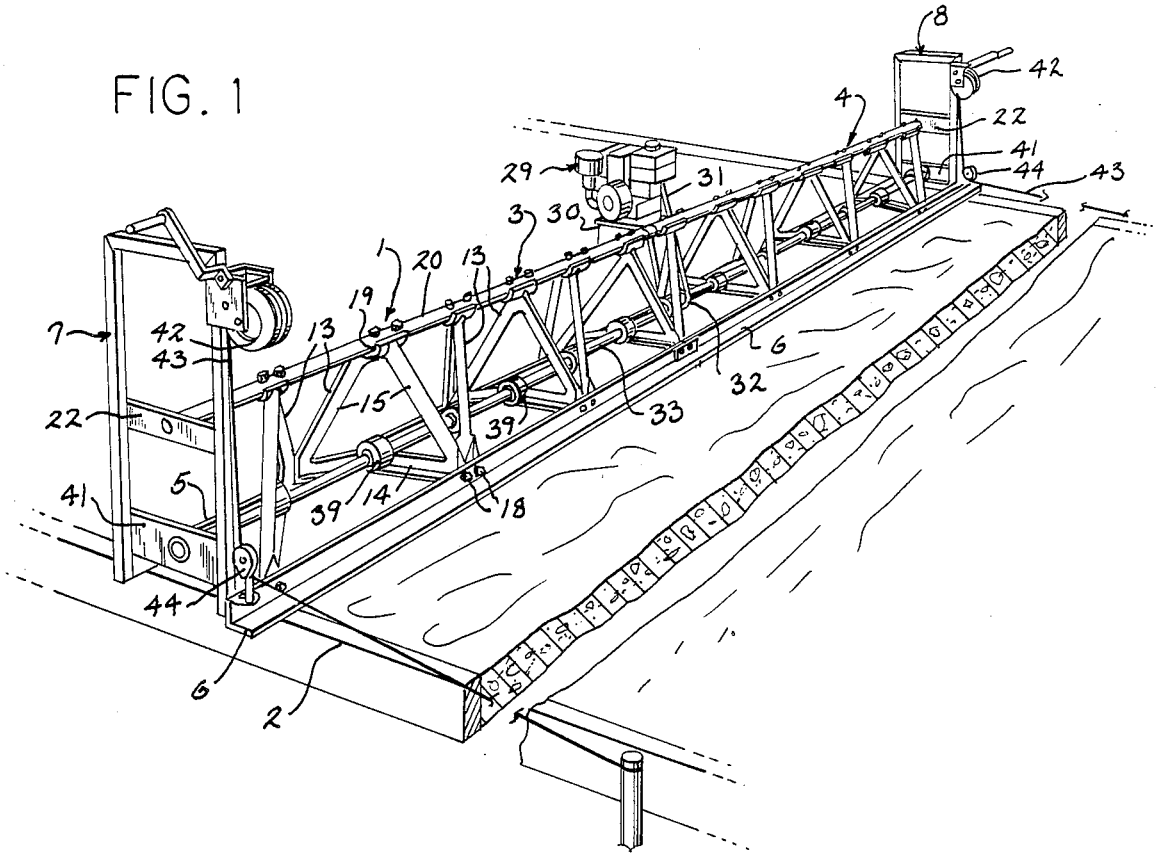
FIG. 1 is a perspective view of the screed of the invention.

FIG. 1 illustrates the screed 1 of the invention as used to finish a slab 2 of concrete. Screed 1 is composed of a series of sections which are disposed in end-to-end relation and while FIG. 1 shows two sections 3 and 4, it is contemplated that one or more sections can be utilized depending upon the dimensions of the slab 2 to be finished.

Each section 3, 4 includes a pair of angle shaped screed plates or rails 5 and 6. Screed plates 5 and 6 of section 3 are connected by a generally rectangular end frame 7, while the corresponding ends of screed plates 5 and 6 of section 4 are connected by a similar end frame 8.

Figure 2:
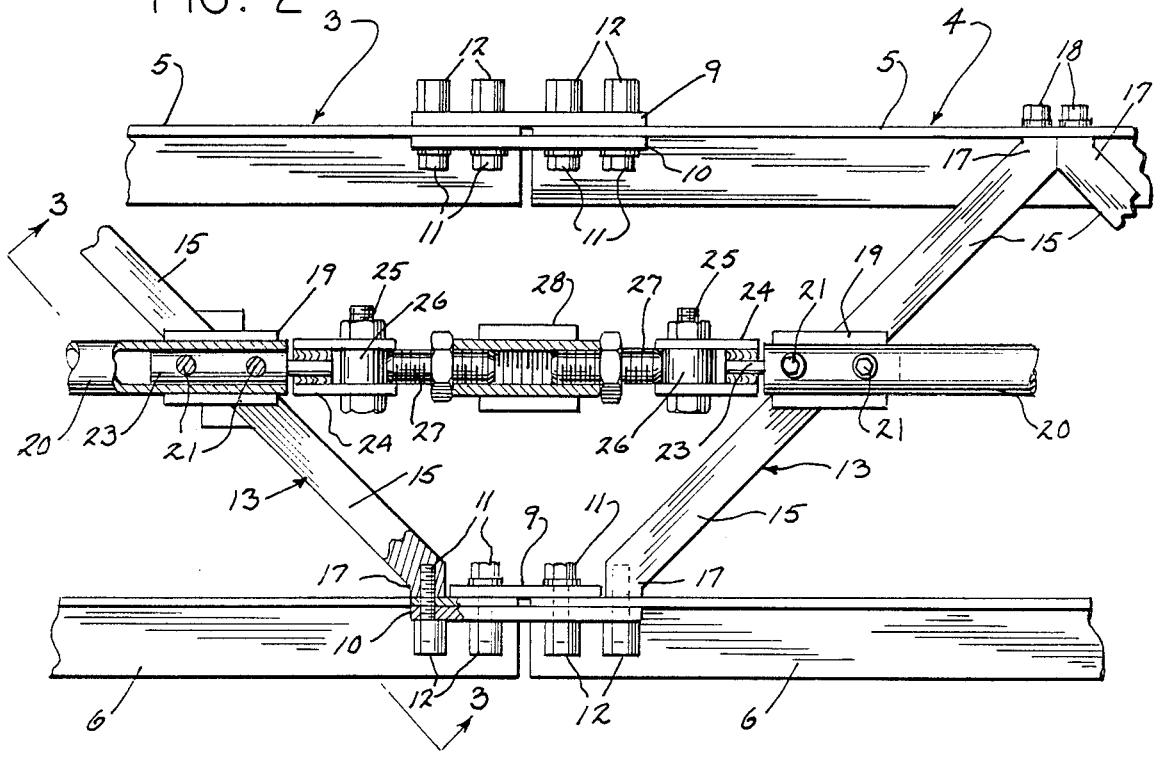
FIG. 2 is a fragmentary top elevation of a portion of the screed.

Screed plates 5 and 6 of section 3 are connected to the corresponding screed plates of the section 4 as best illustrated in FIG. 2. The connection is made by a pair of splice plates 9 and 10 which are positioned on opposite sides of the vertical flanges of the screed plates 5 and 6 and are connected to the screed plates by bolts 11. The heads of the nuts located on the outside of screed plates 5 and 6 can be enclosed by protective covers 12 to prevent the concrete from contacting the nuts.

Screed plates 5 and 6 of each section 3, 4 are interconnected by a plurality of generally triangular frame members 13 which are preferably formed of a light weight material, such as aluminum. As best shown in FIGS. 1 and 2, frame members 13 are located at an acute angle, preferably about 45°, with respect to the longitudinal dimension of screed 1 and each frame member 13 is positioned at an angle of about 90° with respect to adjacent frame members.

As illustrated in FIG. 3, each frame member 13 includes a base 14 and a pair of sides 15 which are connected at an apex 16. As shown in FIG. 2, the ends of base 14 are provided with angular feet 17 which are connected to the vertical leg of the respective screed plates 5 and 6. In addition, feet 17 of one frame member are in contiguous or abutting relation with feet 17 of adjacent frame members, except in the area of the splice plates 9, 10 where the feet 17 are spaced apart in order to accommodate the splice joint. Bolts 18 connect feet 17 to the vertical legs of screed plates 5 and 6, respectively.

The apex of each frame member 13 is provided with a generally semi-cylindrical cradle 19 and a ridge tube 20 extends between the cradles and is secured to the cradles by bolts 21. The outer end of ridge tube 20 of screed section 3 is connected to a cross brace 22 of end frame 7, and similarly, the outer end of ridge tube 20 of screed section 4 is connected to a similar cross brace 22 on end frame 8.

The ridge tubes 20 of sections 3 and 4 are adapted to be axially adjustable relative to each other to vary the crown of the screed. In this regard, a rod 23 is secured within the inner end of each ridge tube 20, as shown in FIG. 2, and is secured to the respective cradle 19 by bolts 21. The projecting end of each rod 23 carries a clevis 24 which is connected by bolt 25 to a sleeve 26. Threaded stub 27 is secured to the outer surface of each sleeve 26 and the two studs 27 are connected together by a conventional turnbuckle 28. The threads on studs 27 have opposite hands so that rotation of the turnbuckle 28 will move the studs 27 and the ridge tubes 20 toward or away from each other in an axial direction to thereby vary the crown on the screed.

Bolts 25 act as pivots to permit the two ridge tubes 20 to tilt or pivot relative to each other in a vertical plane. This pivoting action prevents jamming of the adjusting mechanism and elminates undue stress on the connecting parts as the crown on the screed is varied.

In the embodiment shown in FIG. 1, vibratory motion is provided for screed 1 through operation of a conventional gasoline engine 29 operating through an eccentric mechanism. As shown in FIG. 1, engine 29 is supported by a support bracket 30 from one of the ridge tubes 20 and the output shaft of the engine is connected through belt drive 31 to a pulley 32 mounted on a shaft 33. Each screed section 3, 4 includes a shaft 33 and the adjacent ends of shafts 33 are connected by a flexible coupling 33*a*, shown in FIG. 9. Coupling 33*a* is formed with an internal spline that engages external splines on the abutting ends of shafts 33. Coupling 33*a* acts to transmit rotation between the shafts, and due to its flexible nature, will compensate for any misalignment between the shafts.

As best shown in FIG. 4, each shaft 33 is secured within an opening 34 in sleeve 35. Opening 34 is offset from the axis of sleeve 35 to provide eccentric motion. Each shaft 33 is secured within the respective sleeve 35 by set screws 36.

Each sleeve 35 is journalled within a bearing 37 which is mounted within an opening 38 in hub 39 of frame member 13. As shown in FIG. 4, bearing 37 is mounted against an internal shoulder 40 in opening 38. As shown in FIGS. 3 and 4, hub 39 is located centrally of base 14 and the axis of the hub is aligned with the longitudinal dimension of screed 1 and thus is at an angle of about 45° with respect to the face or plane of the frame member. The ends of shaft 33 extend within openings in cross plates 41 of the respective end frames 7 and 8.

While the drawings show a sleeve 35 having an eccentric opening 34 and mounted within an annular bearing 37, it is contemplated that an eccentric bearing can be used in which the opening in the bearing that reeives the shaft is offset from the axis of the bearing. As a further alternative, weights can be applied at spaced intervals along the length of shaft 33 to provide the vibratory motion, in place of the eccentric sleeves or bearings.

Screed 1 can be moved along slab 2 in any desired manner. As shown in FIG. 1, a winch mechanism is employed but it is contemplated that the screed can be moved manually or by a power operated system. As illustrated in FIG. 1, a winch 42 is mounted on each of the end frames 7, 8 and carries a cable 43. Cables 43 pass around pulleys 44 mounted on the respective end frames 7, 8 and the free end of each cable is connected to a stake or fixed object. By operating the winches 42 in unison, the screed 1 will be moved along slab 2 to provide the finishing action.

The frame members 13 which are set at an angle of about 45° with respect to the longitudinal dimension of the screed provide a strong, lightweight construction which eliminates the need for auxiliary bracing.

The adjusting mechanism for the ridge tubes 20 permits the ridge tubes to tilt or pivot relative to each other in a vertical plane and thus elminates binding and undue stress on the adjusting elements as the crown is adjusted.

FIGS. 6–8 illustrate a modified form of the invention in which pneumatic vibrators are used to provide the vibratory motion for screed 1. As best shown in FIG. 6, each frame section 3, 4 includes an air supply tube 46 and adjacent ends of tubes 46 can be joined together by a suitable coupling. Each air supply tube 46 is disposed within the aligned openings 38 of hubs 39 of frame members 13. The outer end of the air tube 46 associated with screed section 3 is connected to a source of air under pressure such as a compressor 47, while the outer end of tube 46 of the screed section 4 can be closed off by a suitable plug.

To prevent rattling of tube 46, suitable rubber or resilient bushings 48 can be located between tube 46 and the hubs 39.

A series of pneumatic vibratory units 49 are mounted along the length of each screed section and as illustrated in FIG. 6, each vibratory unit 49 is mounted through a bracket 50 to one of the screed plates 5 or 6. A conduit 51 connects air supply tube with each of the vibratory units 49.

Each vibratory unit 49 includes a cylinder 52 having an inlet opening 53 which is connected to conduit 51.

The lower open end of cylinder 52 is enclosed by a threaded cap 54 and the lower projecting end 55 of cap 54 extends through an opening in bracket 50 and receives a nut 56 to mount the vibratory unit on the bracket 50. Mounted for sliding movement within cylinder 52 is a piston 57, and opposite ends of the piston are provided with reduced diameter extensions indicated by 58 and 59.

The inner wall of cylinder 52 is provided with a circumferential groove 60 that communicates with inlet opening 53 and piston 57 is provided with a pair of passages 61 and 62. One end of each passage communicates with the periphery of the piston while the opposite end of each passage extends through the respective end 58 and 59.

Air entering cylinder 52 through inlet 53 will pass from groove 60 into the end of passage 61, when the piston is in the position shown in FIG. 7. The air will then be discharged from passage 61 through end 58 and the pressure of the air will cause the piston to move downwardly to move passage 61 out of communication with groove 60 and bring passage 62 into communication with groove 60 to thereby supply air to the lower end of the piston. As the piston moves downwardly, the air in the upper end of the cylinder will be exhausted through the vent hole 63. This action moves the piston in a very rapid reciprocating manner to provide vibratory motion for the screed.

The screed construction of the invention can be readily adapted for use either with a mechanical vibratory unit or a pneumatic unit without any appreciable change in construction. As previously described, when used with mechanical vibratory unit, the eccentric shaft extends through the aligned hubs in the frame members, while when used with a pneumatic vibratory unit, the air supply tube extends through the aligned openings in the hubs.

Various modes of carrying out the invention are contemplated as being within the scope of the following claims particularly pointing out and distinctly claiming the subject matter which is regarded as the invention.

I claim:

1. A vibratory screed, comprising an elongated screed section including a plurality of frame members, each frame member being generally triangular in configuration and including a base and a pair of sides that are connected together at an apex, the base of each frame member being disposed at an acute angle with respect to the longitudinal dimension of said section and each frame member being disposed at an angle to adjacent frame members, the ends of the base of each frame member being disposed in proximate relation to the ends of the bases of adjacent frame members, plate means carried by the bases of said frame members and disposed to engage and finish the upper surface of a concrete slab, a hub carried by each frame member and defining an opening with each opening disposed generally parallel to the longitudinal axis of said section, said openings disposed in axial alignment, the axis of each opening being disposed at an acute angle to the respective frame member, an elongated member disposed within said aligned openings, connecting means for connecting the upper ends of said frame members, and vibratory means operably connected to said frame members for affecting vibration of said screed section.

2. The screed of claim 1, wherein said elongated member comprises an eccentricly mounted shaft operably connected to said vibratory means.

3. The screed of claim 1, wherein said elongated member comprises a fluid supply conduit and said vibratory means comprises a fluid cylinder, said screed also including conduit means connecting the fluid supply conduit with said cylinder.

4. The screed of claim 1 and including an upwardly facing cradle connected to the apex of each frame member, said connecting means comprising a rod mounted in said cradles.

5. The screed of claim 1, wherein said vibratory means includes a plurality of fluid operated vibratory units mounted on each section, the base of each frame member being provided with an opening, each opening being disposed generally parallel to the longitudinal dimension of said screed section and said openings being disposed in axial alignment, an air supply tube disposed within said aligned openings, means for supplying a gas under pressure to said supply tube, and conduit means interconnecting said supply tube with each of said vibratory units.

6. The screed of claim 1, wherein the ends of the base of each frame member are provided with laterally extending feet, the feet on each frame member being secured to the feet of adjacent frame members.

7. The screed of claim 1, and including an annular bearing mounted in each opening, a sleeve journalled within each bearing, each sleeve having an eccentric bore therein, said elongated member being fixed in said eccentric bores.

8. A vibratory concrete screed, comprising an elongated screed section including a plurality of frame members, each frame member being disposed in a generally vertical plane and at an acute angle with respect to the longitudinal dimension of said screed section and each frame member being disposed at an angle to adjacent frame members, each frame member being generally triangular in configuration and including a base and a pair of sides that are connected together at an apex, the ends of the base of each frame member being connected to the ends of the bases of adjacent frame members, a pair of screed plates carried by the lower ends of said frame members, said screed plates extending to a level beneath said frame members and disposed to engage and finish the upper surface of a concrete slab, and connecting means for connecting the upper ends of said frame members, said frame members constituting the sole structural connection between said screed plates and said connecting means.

9. In a vibratory concrete screed, a plurality of screed sections disposed in end-to-end relation, each screed section including a plurality of frame members, plate means carried by the lower ends of said frame members and disposed to engage and finish the upper surface of a concrete slab, a ridge member connecting the upper ends of the frame members of each section, the ridge members of adjacent sections being axially aligned, a pair of threaded rods, removable connecting means for pivotally connecting a first end of each rod about a horizontal pivot axis to an end of a ridge member, and turnbuckle means threadedly engaged with second ends of said rod for moving the rods axially relative to each other to thereby adjust the crown of said screed, removal of said connecting means enabling said screed sections to be separated without disengagement of said turnbuckle means.

10. In a vibratory concrete screed, a plurality of screed sections disposed in end-to-end relation, each screed section including a plurality of generally triangular frame members with each frame member having a base and a pair of sides connected together at an apex, plate means carried by the bases of said frame members and disposed to engage and finish the upper surface of a concrete slab, a connecting member connecting the apexes of the frame members of each section, a hub carried by each frame member and defining an opening with the openings in the respective frame sections being in axial alignment, journalling means including an outer annular bearing member secured to each hub and having an opening disposed concentrically of the axis of said outer bearing member, said journalling means also including an inner bearing member journalled in said opening and having a bore disposed eccentrically of said axis, a shaft fixedly secured in said bore, and means for rotating said shaft whereby the eccentric orientation of said bore will impart vibration to said screed sections.

* * * * *

UNITED STATES PATENT AND TRADEMARK OFFICE

CERTIFICATE OF CORRECTION

PATENT NO. : 4,758,114

DATED : July 19, 1988

INVENTOR(S) : THOMAS G. ARTZBERGER

It is certified that error appears in the above-identified patent and that said Letters Patent is hereby corrected as shown below:

Col. 6, line 61, CLAIM 9, Cancel "rod" and substitute therefor ---rods---

Signed and Sealed this

Seventh Day of May, 1991

*Attest:*

HARRY F. MANBECK, JR.

*Attesting Officer*

*Commissioner of Patents and Trademarks*